US008215521B2

(12) United States Patent
Quinlan

(10) Patent No.: US 8,215,521 B2
(45) Date of Patent: Jul. 10, 2012

(54) FOAM DISPENSER HAVING SELECTIVELY PRESSURIZED CARTRIDGE

(75) Inventor: Robert L. Quinlan, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 173 days.

(21) Appl. No.: 12/799,364

(22) Filed: Apr. 23, 2010

(65) Prior Publication Data

US 2010/0270328 A1 Oct. 28, 2010

Related U.S. Application Data

(63) Continuation-in-part of application No. 12/288,824, filed on Oct. 23, 2008, now Pat. No. 8,141,744.

(51) Int. Cl.
*B67D 7/02* (2010.01)

(52) U.S. Cl. ..... 222/1; 222/190

(58) Field of Classification Search ..... 222/1, 52, 222/61, 190, 195, 325, 394, 396, 397, 400.5, 222/401

See application file for complete search history.

(56) References Cited

U.S. PATENT DOCUMENTS

| | | | | |
|---|---|---|---|---|
| 3,712,512 | A | 1/1973 | Snider | |
| 5,133,500 | A * | 7/1992 | Simpson | 239/150 |
| 5,398,845 | A | 3/1995 | Meyer | |
| 5,439,140 | A | 8/1995 | Meyer | |
| 5,544,788 | A | 8/1996 | Meyer | |
| 5,772,075 | A * | 6/1998 | Ash et al. | 222/1 |
| 6,290,992 | B1 * | 9/2001 | Magnuson-Hawkins | 424/660 |

FOREIGN PATENT DOCUMENTS

| | | |
|---|---|---|
| EP | 0557243 A1 | 8/1993 |
| EP | 0990412 | 8/1993 |
| WO | 90/14037 | 11/1990 |
| WO | 2005/112724 | 12/2005 |

* cited by examiner

*Primary Examiner* — J. Casimer Jacyna

(74) *Attorney, Agent, or Firm* — Renner Kenner Greive Bobak Taylor & Weber

(57) ABSTRACT

A foam dispenser and method of operation of the foam dispenser provides that a cartridge of liquid having an air head is retained in the dispenser and maintained under pressure by an air compressor when at rest, i.e., when the foam dispenser in not being actuated. Air and liquid conduits communicate respectively between the air head and liquid maintained in the cartridge and a foam generating head. Valves selectively close flow through the conduits. In this way, when the foam dispenser is actuated the valves can simply be opened for the appropriate amount of time to advance air and liquid to the foam generating head and dispense foam at a dispensing location.

10 Claims, 3 Drawing Sheets

FOAM DISPENSER HAVING SELECTIVELY PRESSURIZED CARTRIDGE

CROSS-REFERENCE TO RELATED APPLICATION

This application is a Continuation-in-part of U.S. patent application Ser. No. 12/288,824, filed Oct. 23, 2008 now U.S. Pat. No. 8,141,744.

FIELD OF THE INVENTION

The invention herein resides in the art of dispensing systems and, more particularly, to such dispensers adapted for dispensing materials in the nature of a foam. Specifically, the invention relates to a soap foam dispenser, in which a liquid soap is converted into foam by the forceful combination of liquid soap and air in a foaming head. More particularly, the invention relates to a soap foam dispenser having a disposable cartridge and adapted for interconnection with a motor-driven air compressor under control of a control circuit to selectively regulate the pressurization of the cartridge and the requisite dispensing of liquid and air to a foam generating head to create the desired soap foam.

BACKGROUND OF THE INVENTION

Presently in the art of dispensing liquids and gels, it has become desirable to dispense such liquids and gels in the form of a foam. Typically, the foam is generated from combining a liquid or gel material with air in a forceful way, with the combination of air and the liquid or gel then being extruded through a screen, mesh, sponge or the like to obtain a foam of substantially uniform bubbles.

The invention herein will be discussed with regard to soap foam dispensers, in which liquid soap and air are combined as described for achieving the requisite foam. However, it will be appreciated that the concepts of the invention may be extended to the generation of foam from other liquids, gels, and the like, including those of alcohol-based sanitizers. Presently, soap foam is generated in a variety of ways, most of which require the depositing of a quantity of liquid soap in one chamber, an amount of air in another chamber, and compressing the two chambers to forcefully drive liquid and air to a foam generating head for the generation of the foam. Such activities require significant mechanical movement, typically employing a pair of pistons, one for liquid and one for air, to drive the separate quantities to the foam generating member. Typically, these dual chambered pumps are an integral portion of disposable cartridges and add significantly to the cost of such cartridges. Moreover, being of a mechanical nature, the pumps are not given to excessive use and are typically designed to have a useful life only slightly exceeding the number of dispensing cycles available from the cartridge.

Heretofore, the art has been substantially devoid of a soap foam dispenser having the economy of a permanent compressor adapted for intercommunication with replaceable cartridges to drive both the liquid and air portions necessary to generate soap foam at a foam generating head. The instant invention fills that void.

SUMMARY OF THE INVENTION

In light of the foregoing, it is a first aspect of the invention to provide a foam dispenser having a selectively pressurized cartridge in which the disposable cartridge is devoid of any pump mechanism.

A further aspect of the invention is to provide a foam dispenser having a selectively pressurized cartridge in which the cartridge is disposable.

Yet a further aspect of the invention is the provision of a foam dispenser having a selectively pressurized cartridge in which an air compressor is maintained as a fixed portion of the dispenser and is adapted for communication with disposable cartridges, and in which the compressed air from the air compressor is adapted for driving both the liquid and air portions necessary for generating foam.

Another aspect of the invention is the provision of a foam dispenser having a selectively pressurized cartridge in which the cartridge is adapted for interconnection between a permanent air compressor and dispensing head, and in which the cartridge is also adapted to receive a vent valve and pressure sensor, all under control of a control circuit which is a constituent part of the dispenser.

It is still a further aspect of the invention to provide a foam dispenser having a selectively pressurized cartridge which is cost effective and easy to implement with state of the art structures and materials.

The foregoing and other aspects of the invention that will become apparent as the detailed description proceeds are achieved by a foam dispenser, comprising: a housing; a cartridge received within said housing, said cartridge comprising an interior having a liquid section and an air section; an air compressor in selective communication with said air section; a foam generating head; an outlet air conduit extending between said air section and said foam generating head; an outlet liquid conduit extending between said liquid section and said foam generating head; and wherein said air compressor generates a pressure head in said air section, said pressure head separately forcing both air and liquid respectively through said outlet air and liquid conduits to said foam generating head.

Other aspects of the invention that will become apparent herein are attained by a foam dispenser, comprising: a housing; and a cartridge received within said housing, said cartridge comprising an interior having a liquid section and an air section, air in said air section being in direct contact with liquid in said liquid section, said cartridge further being adapted to receive a compressed air inlet and liquid and compressed air outlets.

Yet other aspects of the invention that will become apparent herein are attained by a method for dispensing foam from a foam dispenser. The foam dispenser includes a dispenser housing; a cartridge removable and replaceable within the dispenser housing, the cartridge containing a foamable liquid section and an air section; an air compressor communicating with the air section; a foam generating head; an outlet air conduit extending between the air section and the foam generating head; an air dispensing valve associated with the outlet air conduit to regulate the flow of air therethrough; an outlet liquid conduit extending between the liquid section and the foam generating head; and a liquid dispensing valve associated with the outlet liquid conduit to regulate the flow of liquid therethrough. The method includes the steps of maintaining the pressure within the cartridge within a desired dispensing pressure range while the foam dispenser is unactuated, the pressure being generated by the air compressor and establishing a pressure head in the air section of the cartridge to separately force both air and liquid respectively toward the air dispensing valve and the liquid dispensing valve. The method also includes maintaining the air dispensing valve and the liquid dispensing valve in a closed position while the foam dispenser is unactuated to prevent flow of air and liquid through their respective outlet air conduits and outlet liquid conduits to the foam generating head. Upon receiving an actuation request of the foam dispenser, the method further includes opening the air dispensing valve and the liquid dispensing valve so that air and liquid flow to and through the foam generating head under the pressure established in said step of maintaining the pressure within the cartridge within a desired dispensing pressure range.

BRIEF DESCRIPTION OF THE DRAWINGS

For a complete understanding of the various aspects and techniques of the invention, reference should be made to the following detailed description and accompanying drawings wherein.

DETAILED DESCRIPTION OF ILLUSTRATIVE EMBODIMENTS

Figure 1:
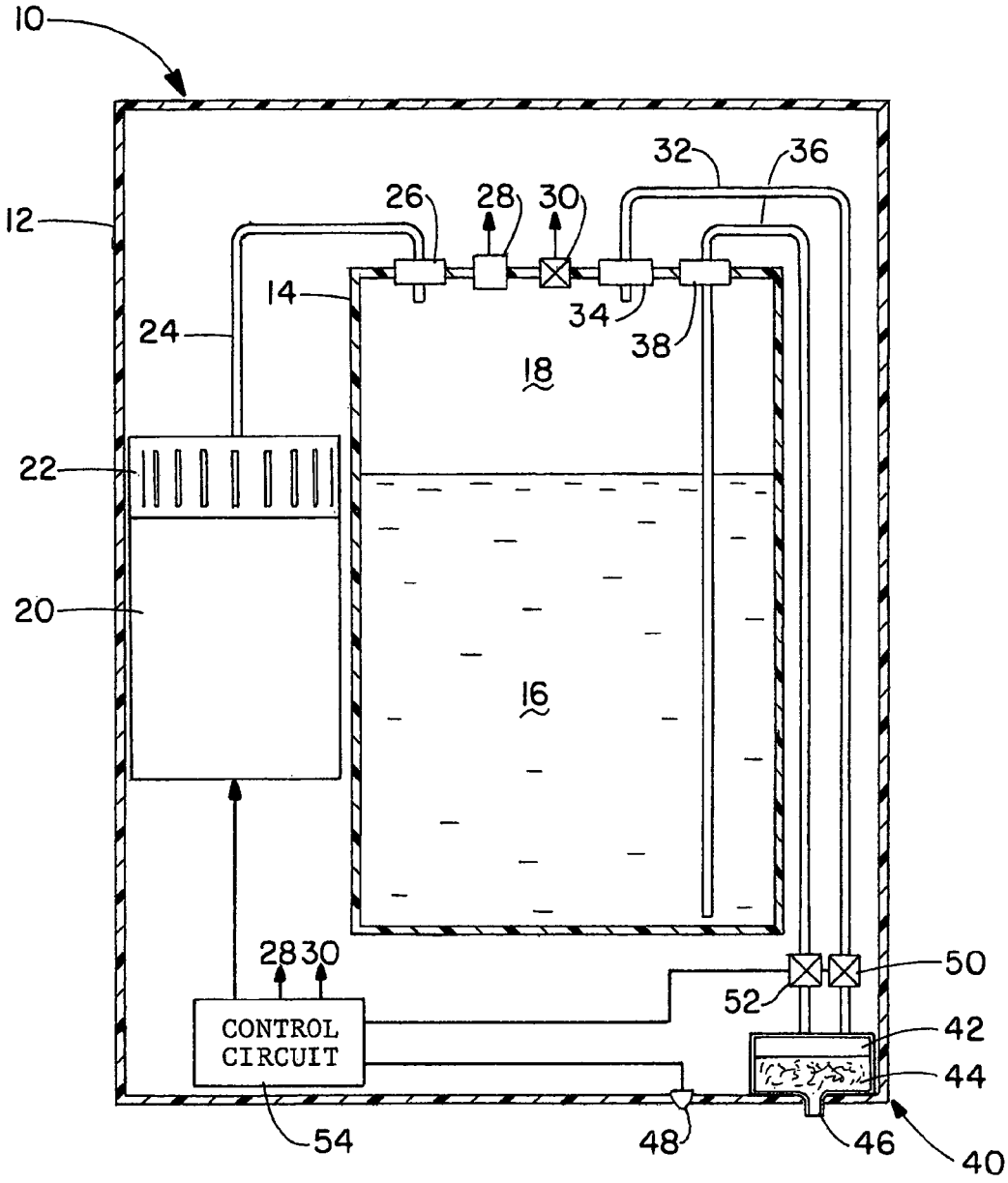
FIG. 1 is an illustrative sectional view of a foam dispenser having a selectively pressurized cartridge therein, made in accordance with the invention.

Referring now to the drawings and more particularly FIG. 1, it can be seen that a foam dispenser according to the invention is designated generally by the numeral 10. The foam dispenser 10 is defined by a housing 12 of a somewhat standard nature. Such dispensers are now commonly known, with the dispenser 10 being of the general wall-mount configuration. Typically, the housing 12 will have a hinged front or cover to allow access to the interior thereof for replacement of the cartridge 14, as desired. The cartridge 14 maintains therein a liquid or gel such as those employed in generating soap or sanitizing foams. The cartridge 14 is a removable, disposable and replaceable cartridge, as that feature is readily known and understood in the art. Typically, the cartridge 14 is a blow-molded cartridge of an appropriate plastic material.

The cartridge 14 is adapted to maintain therein a fluid 16 in a lower portion thereof, with air 18 being maintained therabove. The fluid 16 and air 18 comprise substantially the entirety of the interior of the cartridge 14, with the air and fluid being in contact with each other, without the use of a separating bladder, membrane or the like. As will become apparent herein, the air 18 is selectively pressurized to create a pressure head within the cartridge 14 to assist in the dispensing operation.

Received and maintained within the housing 12 is a motor 20 operative to drive an air compressor 22. A conduit 24 extends from the air compressor 22 to a removable plug seal 26 maintained in the top of the canister 14. The plug seal 26 is adapted to seal an aperture in the top of the cartridge 14 and to also seal about the exterior of the conduit 24, such that conduit 24 can pass into the air head 18 of the cartridge 14 in a sealed manner.

Also received within a top of the disposable cartridge 14 by means of removable plug seals are a pressure sensor 28 and a vent valve 30. The pressure sensor 28 produces a signal corresponding to the pressure head in the air portion 18 of the cartridge 14, while the vent valve 30 is operative to vent the air chamber 18 to atmosphere, as desired.

An air conduit 32 is received by a removable plug seal 34 and extends into the air head 18, as shown. Similarly, a liquid conduit 36 is received by a removable plug seal 38 to pass into the interior of the cartridge 14 and to the bottom portion thereof retaining the liquid 16 to ensure dispensing of the entire contents of the cartridge 14.

The air conduit 32 and liquid conduit 36 extend to a foam generator and dispensing head 40, as shown. The foam generating head 40 includes a mixing chamber 42 having an extruding chamber 44 therebeneath. Those skilled in the art will appreciate that the mixing chamber is substantially a void area in which the liquid soap and air are forcefully combined and then extruded through a screen mesh, sponge, foam block or the like comprising the element 44, and thence out of the dispensing nozzle 46.

Also included as a part of the foam dispenser 10 is a hand detector or proximity sensor 48, which may be of any of various types understood by those skilled in the art. The hand sensor 48 emits a signal upon determining the presence of an object, typically a user's hands, within a particular region beneath the dispensing nozzle 46.

The air conduit 36 is characterized by an air dispensing valve 50, and the liquid conduit 36 by the presence of a fluid dispensing valve 52, both valves being preferably positioned in close association with the foam generating and dispensing head 40. The valves 50, 52 may be simple pinch valves operating on the flexible tubing of the conduits 32, 36, or they may have any of various structures as will be appreciated by those skilled in the art.

A control circuit 54 is maintained as an integral portion of the dispenser 10 and within the housing 12. The control circuit 54 is interconnected with the motor 20 to selectively activate the air compressor 22. Similarly, the control circuit 54 interconnects with the valves 50, 52 to selectively open and close such valves. The hand sensor 48 is connected to the control circuit 54 to provide a signal when hands are present. Similarly, the pressure sensor 28 is interconnected with the control circuit 54 to provide a signal indicative of the pressure head in the air space 18 of the cartridge 14. Finally, the control circuit 54 is also interconnected with the vent valve 30 to allow for venting of the air head 18 to atmosphere. Those skilled in the art will appreciate that the valves 30, 50, 52 may be of various types, while conforming with the concepts of the invention. While they may all be controlled by the control circuit 54, it is contemplated that they may be self-regulating, automatically controlled as by a set cracking pressure or the like.

From a structural standpoint, it will be appreciated that motor 20, compressor 22, conduits 24, 32, 36, sensors 28, 48, and valves 30, 50, 52, as well as the foam generating head 40 may substantially all be a permanent part of the dispenser 10 and its housing 12. Each of the disposable cartridges 14 may be adapted to receive, by the use of removable plug seals, the conduits 24, 32, 36, the pressure sensor 28, and the vent valve 30. Accordingly, removal and replacement of cartridges 14 and the necessary interconnections to be effected at such replacement cycle are simple and easy to undertake. Alternatively, it is contemplated that a substantial portion of the structure comprise a portion of the cartridge, being replaced with the cartridge at each such replacement. Such is particularly the case with sanitary sealed cartridges. For example, the cartridge 14 may include as an integral part thereof each of the conduits 24, 32, 36, a pressure sensor 28 (if required), and a vent valve 30 (either self-regulating or externally controlled). The cartridge may also contain, as a part thereof, the foam generating head 40, and appropriate dispensing valves 50, 52. It will be appreciated that various combinations of elements may comprise the disposable cartridge 14, or be a permanent part of the dispenser 10.

The control circuit 54 may operate the motor and various valves in conjunction with the sensors 28, 48 in any of numerous manners. The flexibility of the operational mode is apparent, in that the control circuit 54 may comprise a simple programmable chip, the program achieving the desired operation. One such operation is illustrated in the flow chart of FIG. 2, in which a method of operation of the foam dispenser 10 is designated generally by the numeral 60. An initiate cycle 62 resets the control circuit 54 and ensures closure of the valves 30, 50, 52, as desired. Following the initiate cycle at 62, the hand sensor 48 is monitored as at 64 to determine if hands are present. That monitoring continues until a determination is made that hands are present, in which case the motor 20 is activated as at 66, which in turn activates the compressor 22 to provide compressed air through the conduit 24 and into the air head 18. The control circuit 54 continues to monitor the pressure in the head 18 through the pressure sensor 28, as is apparent from FIG. 1 and FIG. 2. When the pressure P maintained in the head 18 is equal to dispensing pressure $P_D$, a determination is made that dispensing can be engaged. At this time, the control circuit 54 opens the dispensing valves 50, 52 to allow for air to be driven from the head 18 through the conduit 32 and valve 50 into the mixing chamber 42. Simultaneously, actuation of the valve 52 allows for liquid to be driven from the section 16 of the cartridge 14, through the conduit 36 and into the mixing chamber 42. The valves 50, 52 remain open for a predetermined time $T_1$, this time being an adequate time cycle for dispensing a predetermined volume of foam. The air and liquid are mixed together in the mixing chamber 42 and extruded through the medium 44 and out of the nozzle 46, as will be readily appreciated by those skilled in the art.

It will be understood that when the dispensing valves are opened as at 70, the motor 20 may be turned off under control of the control circuit 54. If desired, the motor and compressor may remain on and operative during the dispensing cycle, or the same can be turned off prior to the dispensing cycle, relying upon the pressure head within the region 18 of the cartridge 14 to effect the dispensing of air and liquid necessary for generating foam. In either event, once the motor 20 and compressor 22 have been turned off and the dispensing cycle has been terminated, action is undertaken at 72 to open the vent 30 to vent the pressure head in the area 18 to atmosphere. The valve 30 may be opened for a set period of time $T_2$ sufficient for such venting, or the valve 30 may be opened to atmosphere until the pressure sensor 28 emits a signal indicating the absence of pressure or the presence of atmospheric pressure. In any event, venting through the valve 30 is desired to prevent over-pressurization of the cartridge 14, which may result in a leak on excessively forceful dispensing of foam.

Those skilled in the art can readily appreciate various types of dispensing cycles that might be undertaken with the system of FIG. 1. For example, it may be desired to open the valve 52 slightly ahead of the valve 50 to allow entry of liquid soap into the mixing chamber 42 slightly ahead of the compressed air, to effect a better blending and generation of foam, if such is found to be the case. As mentioned above, the timing of turning the motor 20 and compressor 22 on and off may also be varied. The motor may be turned off prior to the dispensing cycle, during the dispensing cycle, or following the dispensing cycle, determined by the sequence that results in the best quality of foam, which also depends upon the liquid soap being used.

Figure 3:
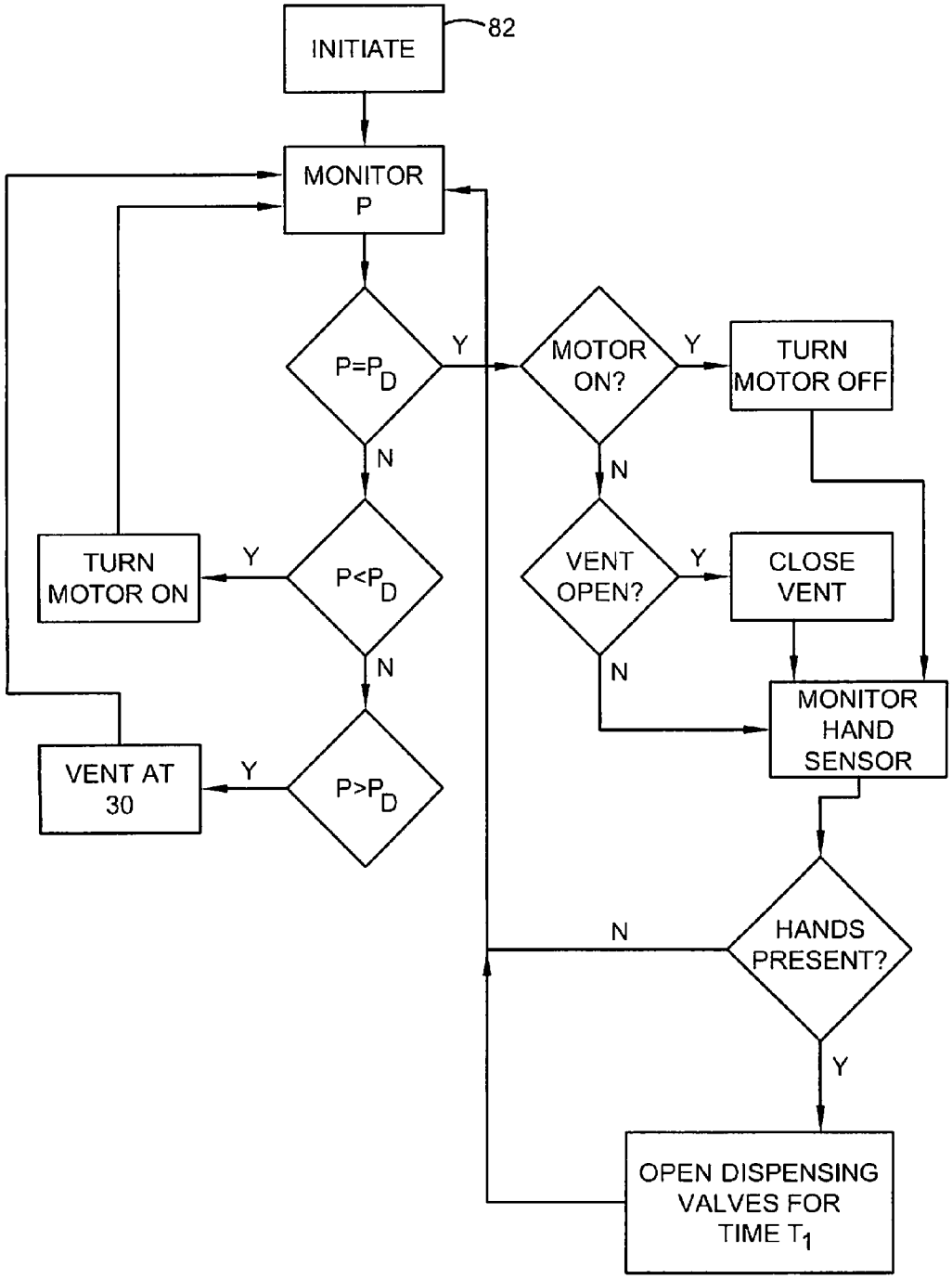
FIG. 3 is a flow diagram showing a second manner of operation of the structure of FIG. 1.

A second operational mode is illustrated in the flow chart of FIG. 3, wherein a method of operation of the foam dispenser 10 is designated generally by the numeral 80. In this operational mode, it is intended that the cartridge 14 always be pressurized to an appropriate pressure when at rest, i.e., when no hands are present at the sensing position of the hand sensor 48. In this way, when a hand is sensed by the hand sensor 48 there is no need for the system to begin pressurizing the cartridge, as in the prior operation mode disclosed above. Instead, the valves 50, 52 can simply be opened for the appropriate amount of time to dispense a desired dose of product at nozzle 46.

With reference to FIG. 3, an initiate cycle 82 resets the control circuit 54 and ensures closure of the valves 30, 50, 52. Following the initiate cycle at 82, the control circuit 54 constantly monitors the pressure P within the cartridge 14, as at 84. The pressure P is monitored for comparison against a desired pressure or pressure range herein referred to as a desired pressure $P_D$. At 86, the monitored pressure P is compared to the desired pressure $P_D$ to determine if P equals $P_D$. Herein, it should be understood that, if $P_D$ is a pressure range, P equals $P_D$ when P is within that pressure range. If the pressure is not equal to the desired dispensing pressure $P_D$, the monitored pressure P is compared to the desired pressure $P_D$ to determine if P is less than $P_D$, as at 88. If the pressure P is less than $P_D$, the motor is turned on, as at 90, and, if the pressure P is not less than $P_D$, it is necessarily greater than $P_D$, as determined at 92, in which case the pressure is released by venting the cartridge 14 at the vent valve 30, as at 94. Whether the motor is turned on as at 90 or the vent 30 is opened as at 94, the pressure P is monitored as at 84, and, once the pressure $P_D$ is reached, either the motor is turned off, as at 96, 98 or the vent is closed, as at 100, 102 to establish the pressure P at the desired pressure or pressure range $P_D$. Through such pressurizing and/or venting, as necessary, the pressure P is brought to the desired dispensing pressure or pressure range $P_D$, and the system can then monitor hand sensor 48, as at 104, to determine if hands are present.

At 106, if hands are not present, the control circuit continues to monitor the pressure, as at 84, and to make adjustments thereto, if necessary, as at 90 and 94. This monitoring helps to ensure that any pressure loss, as perhaps through imperfect plug seals 26, 34, 38, is corrected, as well as any pressure gain, perhaps through a rise in temperature within the cartridge 14. If hands are present when the pressure P is equal to $P_D$, the control circuit 54 opens the dispensing valves 50, 52, as at 108, to allow for air to be driven from the head 18 through the conduit 32 and valve 50 into the mixing chamber 42. Simultaneously, actuation of the valve 52 allows for liquid to be driven from the section 16 of the cartridge 14, through the conduit 36 and into the mixing chamber 42. The valves 50, 52 remain open for a predetermined time $T_1$, this time being an adequate time cycle for dispensing a predetermined volume of foam under the desired pressure or pressure range $P_D$. The air and liquid are mixed together in the mixing chamber 42 and extruded through the medium 44 and out of the nozzle 46 to dispense the product onto the user's hand sensed at hand sensor 48. Once the product is dispensed, the system goes back to monitoring pressure at 84.

Those skilled in the art can readily appreciate various types of dispensing cycles that might be undertaken with the system of FIG. 1. For example, it may be desired to open the fluid dispensing valve 52 slightly ahead of the air dispensing valve 50 to allow entry of liquid soap into the mixing chamber 42 slightly ahead of the compressed air, to effect a better blending and generation of foam, if such is found to be the case. Thus, the timing of opening of valves 50 and 52 can be varied. It might also be desired to leave the air dispensing valve 50 open for a longer time than the liquid dispensing valve 52 in order to clear the dispensing path of residual liquid and/or foam product. This can help prevent the dripping that sometimes occurs when liquid is left in the dispensing path or when foam is left in the dispensing path and breaks down back to a more liquid form. This dripping problem is generally known in the art, and this proposed solution is unique to the presently disclosed dispensing systems.

In other embodiments, the air compressor 22 is designed to generate a maximum pressure, Pmax, which is within the desired dispensing pressure range, $P_D$, such that the cartridge 14 is not likely to ever reach a pressure that is greater than $P_D$, and the vent 30 may be eliminated, along with the venting step in the flowchart. The elimination of the vent 30 decreases the cost of the removable, disposable and replaceable cartridge 14. Also, even if the pressure sensor 28 fails, there is little chance that the cartridge pressure will exceed the desired range $P_D$.

Figure 2:
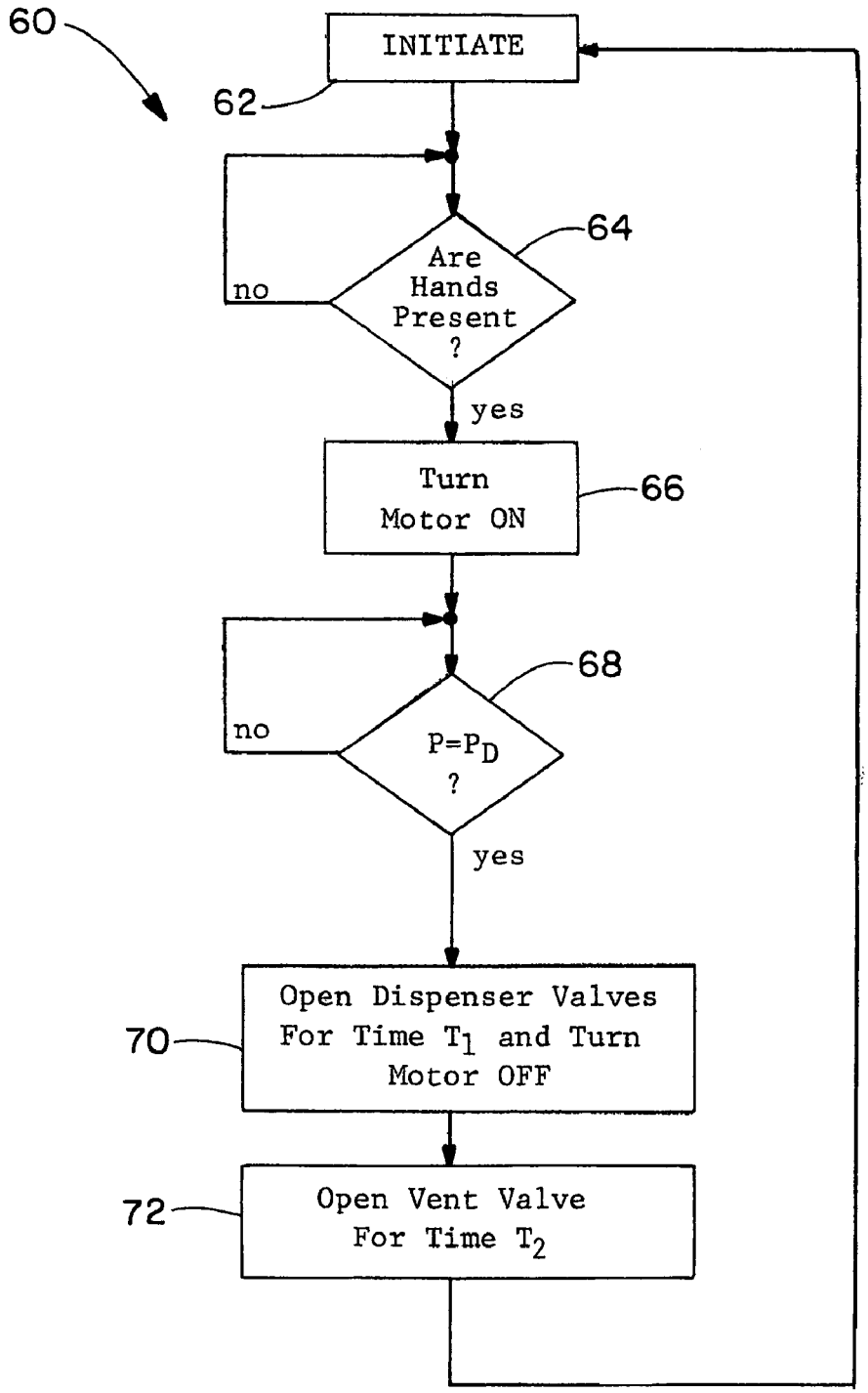
FIG. 2 is a flow diagram showing a first manner of operation of the structure of FIG. 1.

In a particular embodiment in accordance with either the system of FIG. 2 or FIG. 3, the pressure is monitored and maintained at from 2 to 10 psi when the dispenser is unactuated and at rest, i.e., $P_D$ is from 2 to 10 psi. In other embodiments, $P_D$ is from 3 to 6 psi, and in yet other embodiments, form 3 to 5 psi. In another embodiment, the liquid is chosen from gel hand sanitizer products and liquid soap products, and $P_D$ is from 3 to 5 psi.

In a particular embodiment in accordance with either the system of FIG. 2 or FIG. 3, the time $T_1$ that the valves 50, 52 remain open to dispense product is from 0.01 to 1.0 second. In other embodiments, the time $T_1$ is from 0.25 to 0.75 seconds, and, in other embodiments, from 0.25 to 0.5 seconds. In other embodiments, the liquid dispensing valve 52 is opened slightly before the air dispensing valve 50. In other embodiments, the air dispensing valve 50 remains open slightly longer than the liquid dispensing valve 52.

Thus it can be seen that the various aspects of the invention have been attained by the structure presented and describe above. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be made to the following claims.

What is claimed is:

1. A method for dispensing soap, in the form of a foam, from a wall-mounted foam dispenser including: a dispenser housing mounted to a wall; a cartridge removable and replaceable within the dispenser housing, the cartridge containing a foamable soap and an air section; an air compressor fluidly communicating with the air section; a foam generating head; an outlet air conduit providing a fluid pathway between the air section and the foam generating head; an air dispensing valve associated with the outlet air conduit to regulate the flow of air therethrough; an outlet liquid conduit providing a fluid pathway for the foamable soap to the foam generating head; a dispensing nozzle, a hand sensor for sensing the presence of an individual's hand within a particular region beneath the dispensing nozzle; and a liquid dispensing valve associated with the outlet liquid conduit to regulate the flow of foamable soap therethrough, the method comprising the steps of:

maintaining the pressure within the cartridge within a desired dispensing pressure range while the foam dispenser is unactuated, the pressure being generated by the air compressor and establishing a pressure head in the air section of the cartridge to separately force both air and foamable soap, respectively, toward the air dispensing valve and the liquid dispensing valve;

maintaining the air dispensing valve and the liquid dispensing valve in a closed position while the foam dispenser is unactuated to prevent flow of air and foamable soap through their respective outlet air conduits and outlet liquid conduits to the foam generating head; and actuating the foam dispenser by placing a hand beneath the dispensing nozzle so as to be sensed by the hand sensor, said step of actuating causing the air dispensing valve and the liquid dispensing valve to open so that air and foamable soap flow to and through the foam generating head, creating a foam that is dispensed onto the hand beneath the dispensing nozzle, the air and liquid and foam flowing under the pressure established in said step of maintaining the pressure within the cartridge within a desired dispensing pressure range.

2. A method for dispensing foam from a foam dispenser including a dispenser housing; a cartridge removable and replaceable within the dispenser housing, the cartridge containing a foamable liquid section and an air section; an air compressor communicating with the air section; a foam generating head; an outlet air conduit extending between the air section and the foam generating head; an air dispensing valve associated with the outlet air conduit to regulate the flow of air therethrough; an outlet liquid conduit extending between the liquid section and the foam generating head; and a liquid dispensing valve associated with the outlet liquid conduit to regulate the flow of liquid therethrough, the method comprising the steps of:

maintaining the pressure within the cartridge within a desired dispensing pressure range while the foam dispenser is unactuated, the pressure being generated by the air compressor and establishing a pressure head in the air section of the cartridge to separately force both air and liquid respectively toward the air dispensing valve and the liquid dispensing valve;

maintaining the air dispensing valve and the liquid dispensing valve in a closed position while the foam dispenser is unactuated to prevent flow of air and liquid through their respective outlet air conduits and outlet liquid conduits to the foam generating head; and upon receiving an actuation request of the foam dispenser, opening the air dispensing valve and the liquid dispensing valve so that air and liquid flow to and through the foam generating head under the pressure established in said step of maintaining the pressure within the cartridge within a desired dispensing pressure range, wherein the foam dispenser further includes a vent in communication with the air section in the cartridge, and said step of maintaining the pressure within the cartridge within a desired dispensing pressure range includes:

monitoring the pressure, P, within the cartridge, comparing the pressure P with the desired dispensing pressure range, $P_D$, and if P is greater than $P_D$, venting the cartridge through the vent, and if P is less than $P_D$, adding pressure to the cartridge through the air compressor.

3. The method of claim 2, further comprising the steps of:

when said pressure P is within the desired dispensing pressure range $P_D$, monitoring an actuation means of the foam dispenser to determine if the foam dispenser has been actuated.

4. The method of claim 3, wherein the actuation means of the foam dispenser includes a hand sensor sensing the presence of a hand at a dispensing location of the foam dispenser, and said step of monitoring an actuation means includes monitoring the hand sensor to determine if a hand is present at the dispensing location.

5. The method of claim 2, wherein $P_D$ is from 2 to 10 psi.

6. The method of claim 1, wherein, in said step of opening the air dispensing valve and the liquid dispensing valve, said valves are open for a time span of from 0.1 to 1.0 seconds.

7. The method of claim 1, wherein, in said step of opening the air dispensing valve and the liquid dispensing valve, said liquid dispensing valve is opened before said air dispensing valve.

8. The method of claim 1, wherein, in said step of opening the air dispensing valve and the liquid dispensing valve, said liquid dispensing valve is opened for a shorter amount of time than said air dispensing valve.

9. The method of claim 1, wherein the air compressor generates a max pressure, Pmax, and said step of maintaining the pressure within the cartridge within a desired dispensing pressure range includes:

monitoring the pressure, P, within the cartridge, comparing the pressure P with the desired dispensing pressure range, $P_D$, and if P is less than $P_D$, adding pressure to the cartridge through the air compressor, wherein Pmax is within the desired pressure range $P_D$.

10. A method for dispensing sanitizer, in the form of a foam, from a wall-mounted foam dispenser including: a dispenser housing mounted to a wall; a cartridge removable and replaceable within the dispenser housing, the cartridge containing a foamable sanitizer and an air section; an air compressor fluidly communicating with the air section; a foam generating head; an outlet air conduit providing a fluid pathway between the air section and the foam generating head; an air dispensing valve associated with the outlet air conduit to regulate the flow of air therethrough; an outlet liquid conduit providing a fluid pathway for the foamable sanitizer to the foam generating head; a dispensing nozzle, a hand sensor for sensing the presence of an individual's hand within a particular region beneath the dispensing nozzle; and a liquid dispensing valve associated with the outlet liquid conduit to regulate the flow of foamable sanitizer therethrough, the method comprising the steps of:

maintaining the pressure within the cartridge within a desired dispensing pressure range while the foam dispenser is unactuated, the pressure being generated by the air compressor and establishing a pressure head in the air section of the cartridge to separately force both air and foamable sanitizer, respectively, toward the air dispensing valve and the liquid dispensing valve;

maintaining the air dispensing valve and the liquid dispensing valve in a closed position while the foam dispenser is unactuated to prevent flow of air and foamable sanitizer through their respective outlet air conduits and outlet liquid conduits to the foam generating head; and actuating the foam dispenser by placing a hand beneath the dispensing nozzle so as to be sensed by the hand sensor, said step of actuating causing the air dispensing valve and the liquid dispensing valve to open so that air and foamable sanitizer flow to and through the foam generating head, creating a foam that is dispensed onto the hand beneath the dispensing nozzle, the air and liquid and foam flowing under the pressure established in said step of maintaining the pressure within the cartridge within a desired dispensing pressure range.

* * * * *